United States Patent [19]

Elderton

[11] 4,119,865

[45] Oct. 10, 1978

[54] FLUID SENSITIVE SHUTDOWN FOR WELL PUMP

[75] Inventor: Peter Platt Elderton, Fountain Valley, Calif.

[73] Assignee: International Telephone and Telegraph Corporation, New York, N.Y.

[21] Appl. No.: 825,771

[22] Filed: Aug. 18, 1977

[51] Int. Cl.[2] ..... H01H 35/18

[52] U.S. Cl. ..... 307/118; 417/43; 200/61.2; 200/81 R

[58] Field of Search ..... 417/33, 38, 43; 200/61.2, 83 D, 81 R, 81.4, 81.9 R, 84 R, 84 B; 307/118

[56] References Cited

U.S. PATENT DOCUMENTS

| | | | |
|---|---|---|---|
| 2,550,093 | 4/1951 | Smith | 417/43 |
| 3,297,843 | 1/1967 | Hoss | 200/81.9 R |

*Primary Examiner*—Gerald P. Tolin

*Attorney, Agent, or Firm*—A. Donald Stolzy

[57] ABSTRACT

A system for disconnecting an oil well pump driving apparatus from a circuit in the absence of a liquid or the like in a pipeline connected from the pump. A vertical member having a cavity in communication with the interior of the pipeline has vertically spaced differential pressure unit (DPU) inlets. The DPU shuts down the pump motor when there is no liquid in the pipeline.

2 Claims, 2 Drawing Figures

FLUID SENSITIVE SHUTDOWN FOR WELL PUMP

BACKGROUND OF THE INVENTION

This invention relates to fluid sensing systems, and more particularly to apparatus for shutting down a pump in the absence of a liquid in a pipeline or the like.

In the past, failures to shut down oil well pumps at times has required high maintenance.

PRIOR ART STATEMENT

Oil pump shutdown systems were disclosed in U.S. Pat. Nos. 2,550,093; 3,276,380; and 3,297,843 issued Apr. 24, 1951, Oct. 4, 1966, and Jan. 10, 1967, respectively.

By themselves, but not with oil pump shutdown systems, differential pressure units are old in the art. See U.S. Pat. No. 2,664,749 issued Jan. 5, 1954.

SUMMARY OF THE INVENTION

A fluid sensing system comprising: a unit adapted to pump oil from a well; means actuable to disable said unit; a pipeline connected from said unit to carry oil pumped from said well by said unit; a vertical member sealed to said pipeline, said member having a cavity in communication with the interior of said pipeline; a differential pressure unit (DPU) having low and high pressure inlets in fixed positions relative to said member and responsive to the respective lower and higher pressures in the interior of said cavity respectively above and below each other, said DPU having an output device to actuate said means when the pressure within said high pressure inlet is the same or different from that in said low pressure inlet; and apparatus to override said means when it is appropriate to restart said unit and to fill said pipeline and/or said member.

The above-described and other advantages of the present invention will be better understood from the following detailed description when considered in connection with the accompanying drawings.

BRIEF DESCRIPTION OF THE DRAWINGS

In the drawings which are to be regarded as merely illustrative.

DESCRIPTION OF THE PREFERRED EMBODIMENTS

Figures 1, 2:
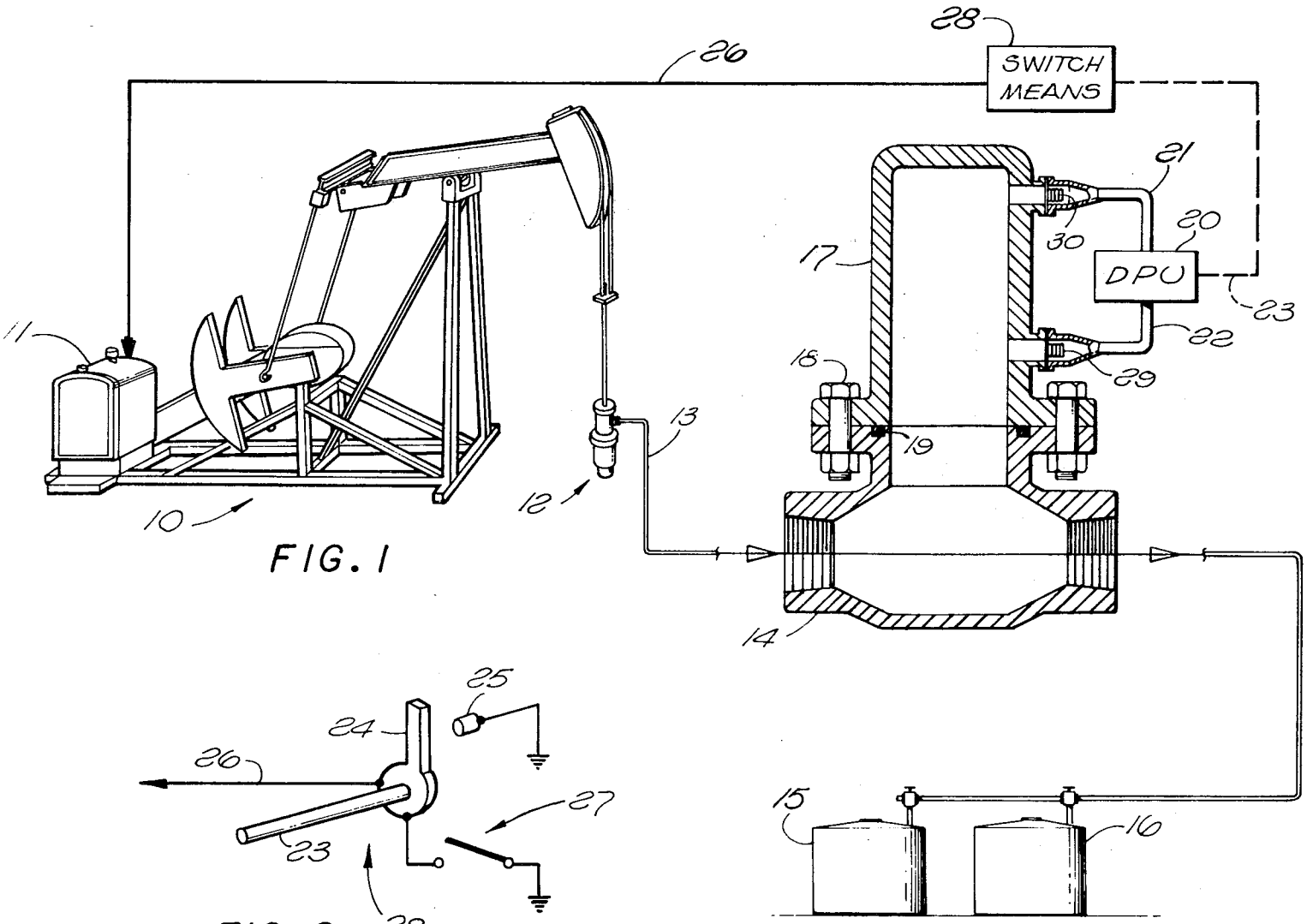
FIG. 1 is a part perspective, part sectional and part elevational view, and a part schematic diagram of the system of the present invention.
FIG. 2 is a part perspective view and a part schematic diagram of electrical switches which control a pump shown in FIG. 1.

An oil well pumping unit is illustrated at 10 in FIG. 1. Unit 10 is substantially, but not necessarily, identical to that shown in U.S. Pat. No. 3,297,843.

An internal combustion engine 11 is provided to drive unit 10. Any apparatus other than engine 11 may also be provided to drive unit 10. Pump apparatus at 12 has an outlet conduit 13 connected to a body 14 through which oil is pumped to storage tanks 15 and 16.

Body 14 has a hollow, cylindrical, vertical member 17 bolted at 18 thereto and sealed thereto by an O-ring 19.

A conventional differential pressure unit (DPU) is provided at 20 having upper and lower inlets 21 and 22, respectively, at the respective upper and lower ends of member 17. The interiors of inlets 21 and 22 each contain a fill fluid which is substantially incompressible and separated from the interior of member 17 by bellows 29 and 30, respectively. When the interior of member 17 is nearly full or partly full of oil, DPU 20, which has a output shaft 23 shown in FIGS. 1 and 2, rotates a conductive contact arm 24 into engagement with grounded contact 25. A lead 26 from arm 24 keeps engine 11 running by completing the distributor circuit thereof.

A manually operable switch 27 can be of the momentary contact type, if desired.

In FIG. 2, switch means 28 of FIG. 1 is illustrated.

OPERATION

If body 14 and member 17 are empty to a certain extent or are totally empty, and engine 11 is not running, engine 11 will remain shut down because switch 27 will be open and DPU 20 will keep arm 24 and contact 25 out of engagement with each other. That is, the distributor circuit of engine 11 will be kept open. Arm 24 will not engage contact 25 because member 17 will not fill with oil because pump 12 will not supply oil when it is not driven by engine 11 and unit 10.

Should it be desirable to start pump 12, switch 27 may be held closed until member 17 fills with oil. DPU 20 will then move arm 24 into engagement with contact 25 and the distributor circuit will thereby be completed. Switch 27 may then be opened and engine 11 will continue to run so long as member 17 is filled or filled to a certain extent with a liquid. The word "oil" herein means oil or any liquid or liquid-like mass. The location of arm 24 on shaft 23 will determine at what oil level in member 17 that arm 24 will disengage contact 25 and shut down engine 11, unit 10 and pump 12. Arm 24 may be fixed or adjustable relative to shaft 23.

Shutdown is useful in protecting engine 11, unit 10 and pump 12 when oil fails to exit conduit 13 or exits therefrom intermittently at regular or irregular intervals and/or gas exits in one or a different one of the same ways. Such a shutdown also saves energy.

What is claimed is:

1. A fluid sensing system comprising: a unit adapted to pump oil from a well; means actuable to disable said unit; a pipeline connected from said unit to carry oil pumped from said well by said unit; a vertical member sealed to said pipeline, said member having a cavity in communication with the interior of said pipeline; a differential pressure unit (DPU) having low and high pressure inlets in fixed positions relative to said member and responsive to the respective lower and higher pressures in the interior of said cavity respectively above and below each other, said DPU having an output device to actuate said means when the difference between the pressures within said high and low pressure inlets is a predetermined magnitude; and apparatus to override said means when it is appropriate to restart said unit and to fill said pipeline and/or said member.

2. The invention as defined in claim 1, wherein said unit is electrically operable, said means including a main switch connected from said unit, said DPU causing said main switch to open to disable said unit, said apparatus including an auxiliary switch connected in parallel with said main switch.

* * * * *